US008544958B2

(12) United States Patent
Holtzinger et al.

(10) Patent No.: US 8,544,958 B2
(45) Date of Patent: Oct. 1, 2013

(54) HOLDER FOR ATTACHING A HEADREST TO THE BACK OF A SEAT

(75) Inventors: Andre Holtzinger, Vescheim (FR); Jean-Francois Host, Sarrebourg (FR)

(73) Assignee: Steelcase S.A., Schiltigheim (FR)

( * ) Notice: Subject to any disclaimer, the term of this patent is extended or adjusted under 35 U.S.C. 154(b) by 399 days.

(21) Appl. No.: 12/812,507

(22) PCT Filed: Jan. 13, 2009

(86) PCT No.: PCT/FR2009/050041

§ 371 (c)(1), (2), (4) Date: Jul. 12, 2010

(87) PCT Pub. No.: WO2009/092955

PCT Pub. Date: Jul. 30, 2009

(65) Prior Publication Data

US 2010/0289316 A1 Nov. 18, 2010

(30) Foreign Application Priority Data

Jan. 14, 2008 (FR) ..... 08 00193

(51) Int. Cl.
*A47C 7/36* (2006.01)

(52) U.S. Cl.
USPC ..... 297/391; 297/399; 297/410

(58) Field of Classification Search
USPC ..... 297/391, 397, 399, 410
See application file for complete search history.

(56) References Cited

U.S. PATENT DOCUMENTS

| | | | | | |
|---|---|---|---|---|---|
| 10,698 | A | * | 3/1854 | Bailey | 297/391 |
| 247,208 | A | * | 9/1881 | Miller | 297/393 |
| 792,669 | A | * | 6/1905 | Schaff | 297/399 |
| 3,223,447 | A | * | 12/1965 | Terracini | 297/397 |
| 4,291,084 | A | * | 9/1981 | Segal | 428/212 |
| 4,498,704 | A | | 2/1985 | Hildreth | |
| 4,647,108 | A | * | 3/1987 | Hayashi | 297/391 |
| 4,848,838 | A | * | 7/1989 | McCrackin et al. | 297/391 |
| 5,205,585 | A | * | 4/1993 | Reuber et al. | 280/753 |
| 5,348,376 | A | * | 9/1994 | Natori | 297/391 |
| 5,374,100 | A | * | 12/1994 | Rogers et al. | 297/61 |
| 5,449,234 | A | * | 9/1995 | Gipp et al. | 374/185 |
| 5,485,979 | A | * | 1/1996 | LaPointe et al. | 248/188.2 |
| 5,853,831 | A | * | 12/1998 | Urabe et al. | 428/35.7 |

(Continued)

FOREIGN PATENT DOCUMENTS

| | | | |
|---|---|---|---|
| EP | 1716786 | | 11/2006 |
| GB | 2418352 | | 3/2006 |
| JP | 57080930 | A * | 5/1982 |

OTHER PUBLICATIONS

International Search Report of PCT/FR2009/050041, 3 pages.

*Primary Examiner* — David E Allred
(74) *Attorney, Agent, or Firm* — Price Heneveld LLP

(57) ABSTRACT

The invention relates to a seat that comprises: a base; a sitting portion and a back support mounted on the base; a back including a shell and a padding attached to the shell; at least one attachment point provided with attachment means for attaching the back holder to the back; a headrest; and a headrest holder. The seat further includes: a bearing profile section adapted for attachment to the top of the shell of the back; and an arm with a planar aspect extending between the padding and the shell of the back, wherein said arm extends down to the attachment point(s) and is held rigidly by the attachment means of the back to the back holder.

11 Claims, 5 Drawing Sheets

(56) References Cited

U.S. PATENT DOCUMENTS 6,843,530 B1 * 1/2005 Wu ..... 297/284.4
6,945,601 B1 * 9/2005 Wu ..... 297/284.4
7,690,729 B2 * 4/2010 Liao ..... 297/408
2011/0316320 A1 * 12/2011 Kulkarni et al. ..... 297/452.48
2012/0205948 A1 * 8/2012 Okuda et al. ..... 297/188.03

* cited by examiner

HOLDER FOR ATTACHING A HEADREST TO THE BACK OF A SEAT

BACKGROUND OF THE INVENTION (1) Field of the Invention

This invention deals with a seat and more particularly with a mechanism for attaching a headrest to the back of a seat. It concerns in particular, but not exclusively, office chairs. In order to ensure the users' comfort, whatever their body type, the headrest must be adjustable for height.

(2) Description of the Related Art

In a number of currently used solutions, the headrest is attached on the holder which is mobile with regard to the back, with the height adjustment being made therefore at the level of the back of the seat. In this scenario, the mechanisms for displacing one element with regard to the other are located on the back. In order to ensure this function, the seat back cannot then be comprised simply of a shell covered with padded upholstery; it must integrate the sometimes sophisticated mechanisms for controlling the displacement of the headrest.

Even in the case of an adjustment at the level of the headrest, the attachment to the back of a corresponding holder, whose manipulation generates mechanical stress, generally gives rise to the designing of a back which is dimensioned and designed to ensure a stable and secure attachment. The structure is conceived on this basis, and in order not to compromise the comfort of the seat, the attachment is generally made behind the shell, on the side opposite the padded side on which the back of the user rests, or between the two shells.

SUMMARY OF THE INVENTION

The present invention takes an approach that is the opposite of these solutions, by proposing a headrest attached in a simple and direct manner between the shell forming the back and the padding which covers said shell.

The seat of the invention, thus allowing the attachment of a headrest to a back, comprises principally:

- a base;
- a sitting portion and a back support mounted on the base;
- a back including a shell and padding attached to the shell;
- at least one attachment point provided with means for attaching the back to the back holder;
- a headrest; and
- a headrest holder, which includes:

- a bearing profile section adapted for attachment to the top of the shell of the back; and
- an arm of planar aspect extending between the padding and the shell of the back, said arm extending to the point(s) of attachment and being held rigidly by the means of attachment of the back to the back holder.

Advantageously, said means of attachment provided for within the scope of the invention thus ensures solid attachment of both the back to the back holder and of the headrest holder to the back holder.

In fact, more precisely, the bearing profile section is in the form of a hook and the arm features at least one positioning stud fitting in a recess of corresponding shape in the shell of the back, where it is attached by the above-cited attachment means.

The upper linking by the profile section produces, in reality, a simple support at the top of the shell of the back, without additional attachment means, and is completed by an arm allowing a positioning in the width of the back. To simplify, it can be said that the vertical positioning is ensured by the bearing profile section in hook form, whereas the horizontal positioning is made by the positioning stud(s).

Preferably, the arm actually features two positioning studs offset laterally toward the exterior and cooperating with two recesses located at the same level and centered in the width of the shell.

The use of the two studs, with their extensions offset laterally towards the exterior, allows the positioning operations to be appreciably facilitated and improves the centering of the headrest.

According to one possible configuration, the arm features two parallel planar branches of vertical aspect, whose lower ends feature divergent dogleg sections ending in the positioning studs.

Each stud is designed hollow, with a bottom featuring a centered orifice allowing the attachment of the headrest holder to the shell of the back and to the holder of the back, by means of a bolt, for example.

The appreciably flat nature of the arm, its slim structure (as will be seen further on) and the fact that the studs are embedded in the recesses of the shell allows the padding of the shell of the back to be ensured under proper conditions, without compromising the comfort of the seat.

According to one possibility, the headrest is attached to an upper portion of the holder which consists of at least one girder of curved aspect acting as a slide rail for the headrest.

Preferably, there are two parallel girders connected, in the area of their free end, by a cross member.

These girders serve as guide rails for the displacement of curvilinear aspect of the headrest, in the vertical direction.

According to one possibility which takes into account the mechanical stresses necessary for this type of part, the headrest holder is produced in a commercialized material under the protected name of nylon PA6, filled with fiberglass at the ratio of 25%-45%.

DETAILED DESCRIPTION OF PREFERRED EMBODIMENT

Figure 1:
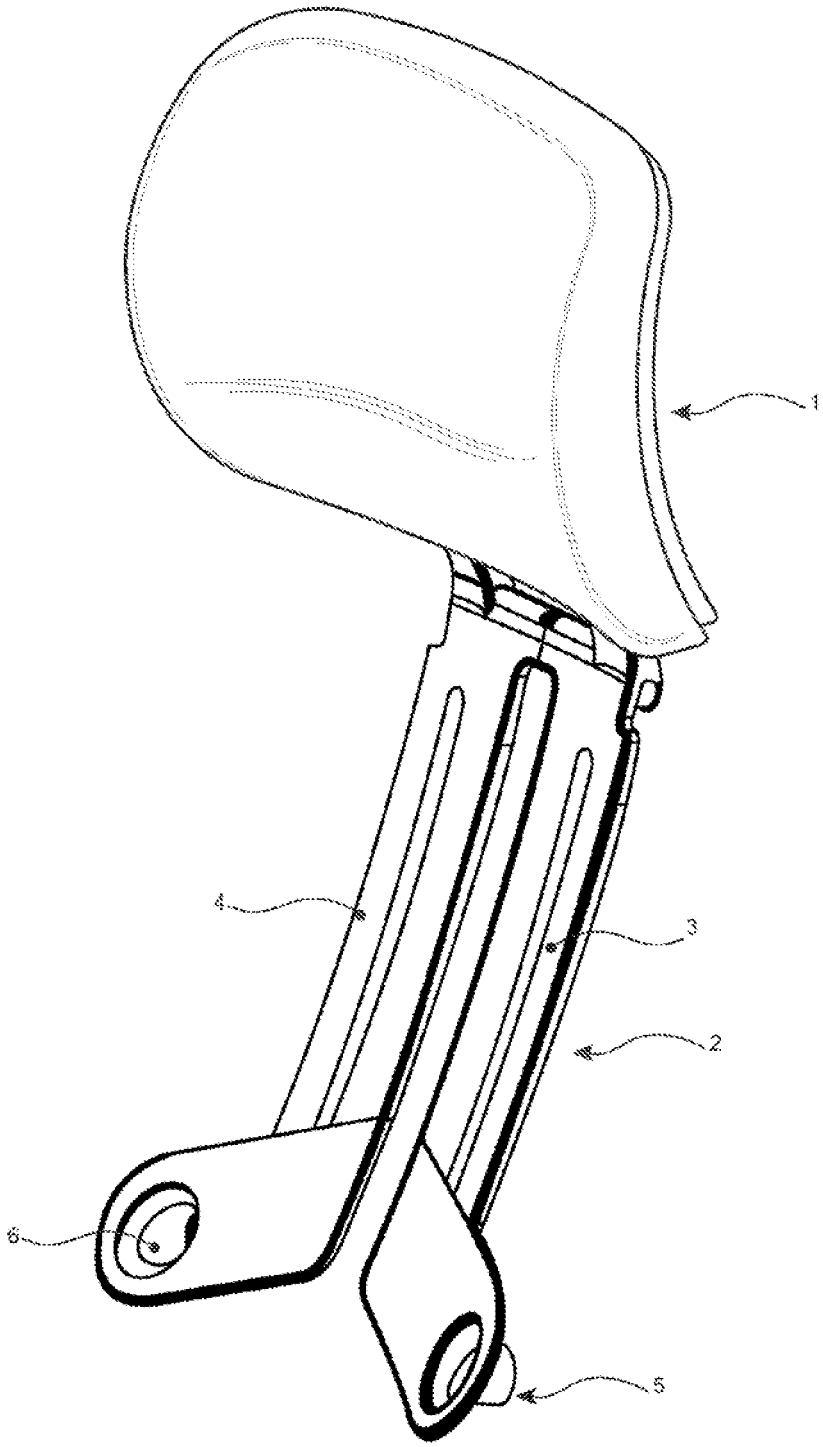
FIG. 1 is a perspective view of a headrest mounted on a holder in accordance with the attachment mechanism of the invention.

Referring to FIG. 1, the headrest (1) is mounted on the upper portion of a headrest holder (2) comprising an arm with two branches (3, 4) of parallel aspect whose lower end is dog-legged and ends in hollow studs (5, 6). A chair (FIG. 3) according to an aspect of the present invention includes a base 27, a seat or sitting portion 26, and padding 25.

Figure 2:
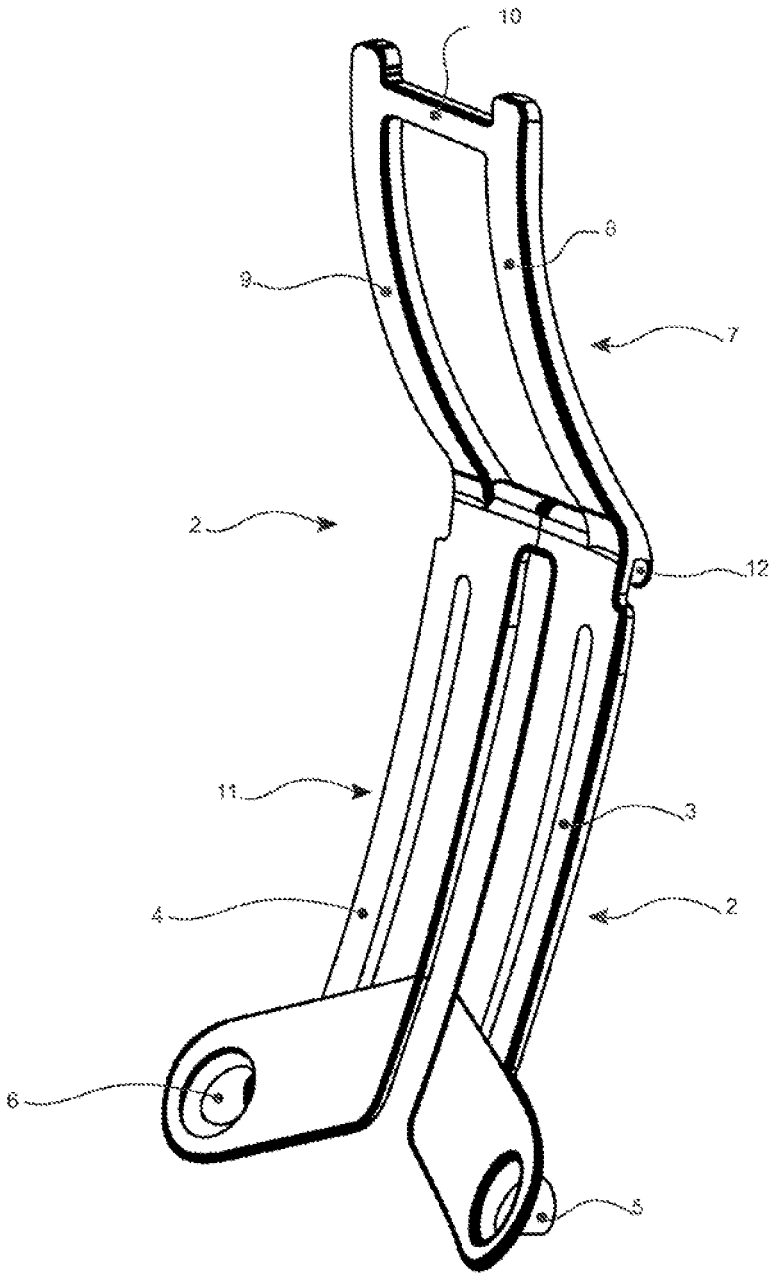
FIG. 2 is a perspective view of the headrest holder of FIG. 1.

The holder (2) also appears in FIG. 2, with an upper portion (7) comprised by two parallel curved girders connected, in the area of their free upper end, by a cross member (10). This figure shows clearly that the holder (2) is comprised of an upper portion (7) and a second portion constituted by an arm (11), which are separated by a bearing profile section (12) in the shape of a hook.

Figure 3:
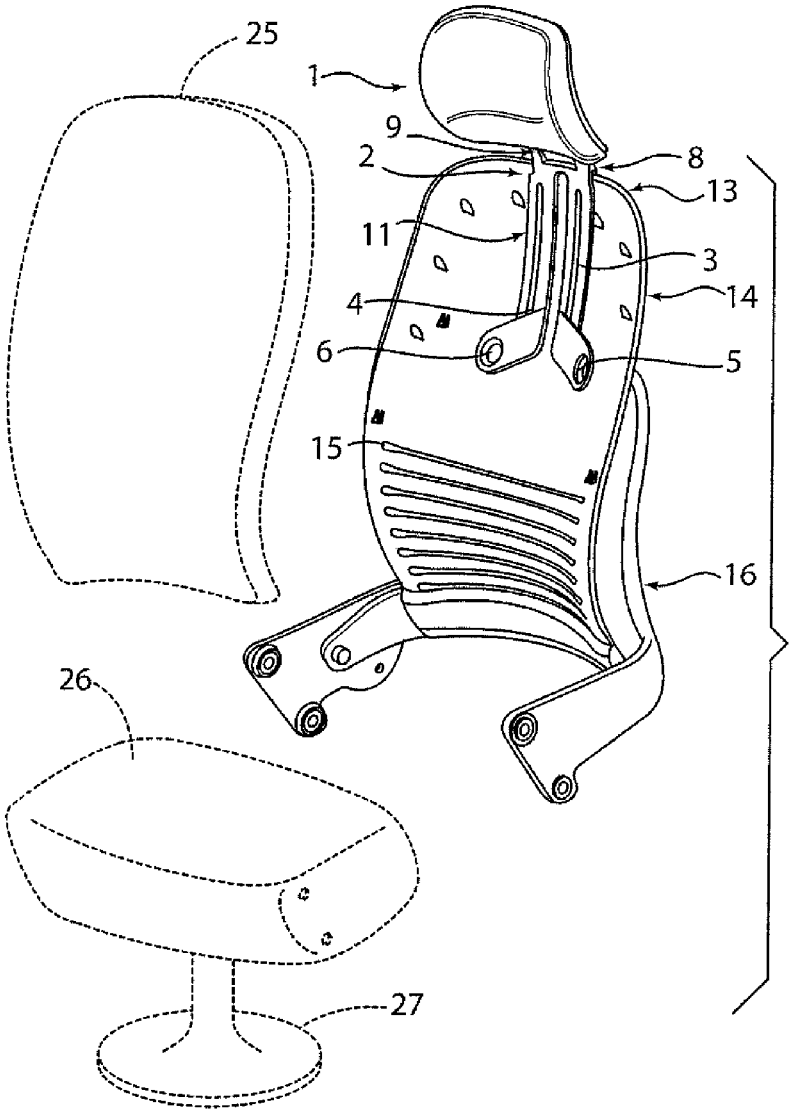
FIG. 3 is an exploded perspective view of a chair including the headrest holder/headrest unit mounted on the shell of the seatback.

This profile section (12) allows the headrest holder (2) to be hooked on the upper edge (13) of the shell (14) of a seat back, such as is shown in FIG. 3. This shell (14), which is not the subject of the invention, features, at the level of the lumbar region, a series of slits (15) allowing its flexibility to be improved, and it is attached at its bottom portion to a back holder (16) comprising additional means of attachment to the rear of the shell (14), in its middle portion.

Figure 4:
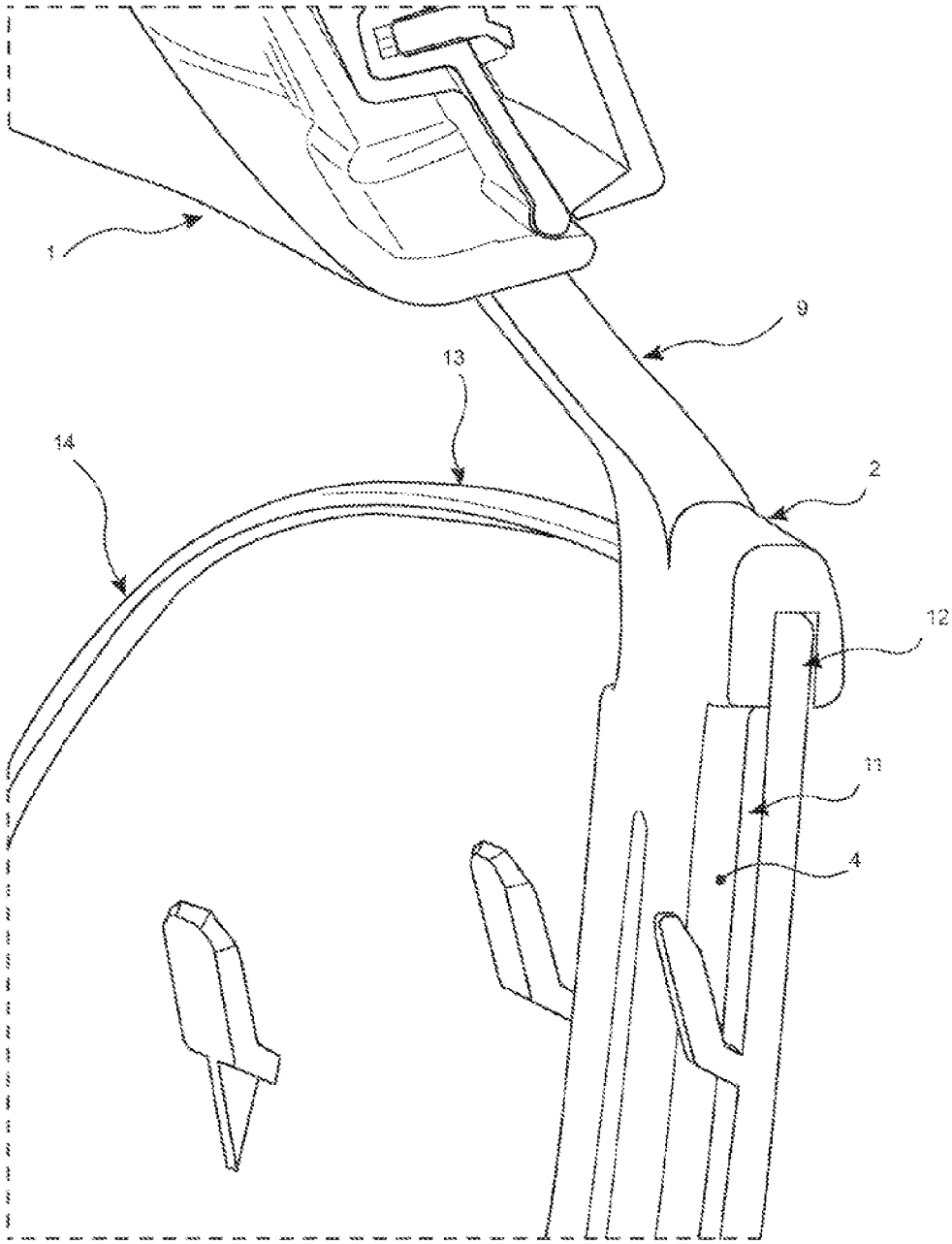
FIG. 4 is a partial cross section detailing the hooking at the upper part of the shell.
Figure 5:
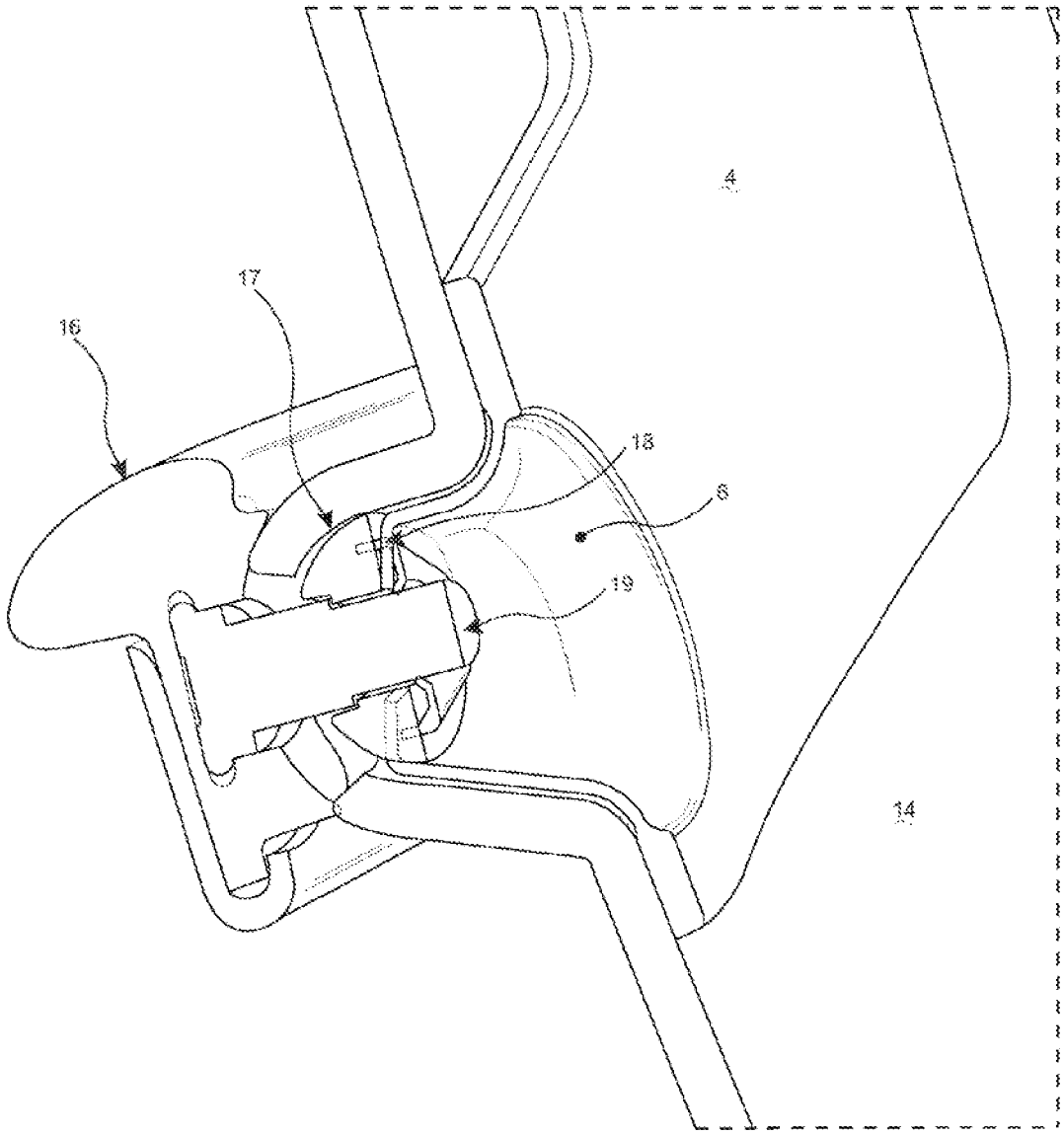
FIG. 5 is a partial cross section of the attachment mechanism at the level of the bottom studs.

FIG. 4 shows an enlarged detail of the attachment of the headrest holder (2) at the level of the upper edge (13) of the shell (14), by means of the profile section (12). The studs (5) and (6) fit then into the corresponding recesses made in the shell (14) of the back, of which one example (17) is shown in detail in FIG. 5. The bottom (18) of the hollow studs is provided with an orifice allowing the passage of a screw (19) of a bolt, whose head is embedded in the horizontal portion of the back holder (16) running along the back of the shell (14). This screw (19) acts on the one hand to fasten said flexible back holder (16) to the shell (14) of the back, and acts on the other hand to solidly attach the headrest holder (2) of the back (1) to said shell (14). The entire unit is then covered with a padded upholstery. In this respect, as it appears in FIG. 5, the slight thickness of the holder (2) does not constitute in any case an inconvenience for the final user, because this part (2) is covered over by a padded covering of thickness sufficient to ensure comfort.

The attachment of the holder (2) to the shell (14) is simple, since it consists in a first stage of hooking the profile section (12) on the upper edge (13) of the shell (14), then of centering it in the width of said shell (14) with the aid of the hollow studs (5) and (6), by their fitting into the corresponding recesses. The final attachment is made by means of the bolt featuring the screw (19).

The example described here-above, illustrated by FIGS. 1 to 5, is in no way exhaustive of the invention. The invention also covers variations such as attachment means equivalent to the bolt, or forms resulting in an equivalent outcome for the branches (3) and (4) or the girders (8) and (9). Preferably, the part (2) is made of nylon PA6 filled with fiberglass. The load should be in the range of 30% to 40%.

The invention claimed is:

1. A chair, comprising:

a back holder adapted to be mounted to a seat base of the chair;

a seat back including a shell;

at least one attachment point including a connecting structure attaching the back to the seat back holder on a first rear side of the shell;

a headrest; and a headrest holder having a bearing profile section hooked to a top of the shell of the seat back, and an arm having at least a portion thereof extending on a second front side of the shell of the seat back, wherein the arm extends to the one attachment point, and wherein the arm is held rigidly, at least in part, by the connecting structure.

2. The chair of claim 1, wherein:

the shell includes a recess defining a shape;

the bearing profile section is in the form of a hook;

the arm includes at least one positioning stud having a shape corresponding to the shape of the recess in the shell, the one positioning stud fitting into the recess in the shell of the seat back.

3. The chair of claim 2, wherein:

the connecting structure comprises a threaded fastener.

4. The chair of claim 1, wherein:

the shell includes a plurality of recesses that are located at a same level;

the arm includes a plurality of positioning studs that are horizontally spaced apart from one another, and wherein the studs engage the recesses in the shell.

5. The chair of claim 4, wherein:

the arm includes a pair of vertically extending portions having generally planar opposite side surface portions, and dogleg lower sections extending outwardly away from one another, and wherein each dogleg lower section includes at least one of the positioning studs at an outer end thereof.

6. The chair of claim 2, wherein:

the one stud comprises a hollow protrusion having a bottom portion with an aperture through the bottom portion, and including:

a threaded fastener extending through the aperture and interconnecting the headrest holder, the shell, and the back holder.

7. The chair of claim 1, wherein:

the holder for the headrest includes an upper portion having a curved slide rail; and the headrest is attached to the upper portion.

8. The chair of claim 7, wherein:

the upper portion of the holder for the headrest includes a pair of parallel curved slide rails defining upper ends, the upper portion further including a cross member connected to the curved slide rails in the area of the upper ends.

9. The chair of claim 1, wherein:

the holder for the headrest comprises nylon PA6 polymer filled with fiberglass in a ratio in a range of 25% to 45%.

10. A chair, comprising:

a back holder adapted to be mounted to a seat base of the chair;

a seat back including a shell having a generally upright front surface and an upper edge portion;

at least one attachment point including a connecting structure attaching the seat back to the back holder;

a headrest; and a headrest holder having a bearing profile section hooked to the upper edge portion of the shell of the seat back, the headrest holder including an arm having at least a portion thereof engaging the upright front surface of the shell, wherein the arm extends to the one attachment point, and wherein the arm is held rigidly, at least in part, by the connecting structure.

11. The chair of claim 10, wherein:

the bearing profile section comprises a downwardly opening hook; and the upper edge portion of the shell is disposed in the downwardly opening hook.

* * * * *

UNITED STATES PATENT AND TRADEMARK OFFICE

CERTIFICATE OF CORRECTION

PATENT NO. : 8,544,958 B2
APPLICATION NO. : 12/812507
DATED : October 1, 2013
INVENTOR(S) : Andre Holtzinger et al.

It is certified that error appears in the above-identified patent and that said Letters Patent is hereby corrected as shown below:

In the Claims

Column 3
Line 50, replace "back" (first occurrence) with --seat back--;
Line 50, delete "seat" (before back holder).

Signed and Sealed this
Fifteenth Day of April, 2014

Michelle K. Lee

Michelle K. Lee
*Deputy Director of the United States Patent and Trademark Office*